US005228154A

United States Patent [19]

Brevi et al.

[11] Patent Number: 5,228,154

[45] Date of Patent: Jul. 20, 1993

[54] FRAMEWORK, PARTICULARLY FOR FOLDING COTS

[75] Inventors: Romano Brevi; Giuliano Brevi; Mauro Brevi, all of Telgate, Italy

[73] Assignee: BREVI s.r.l., Telgate, Italy

[21] Appl. No.: 855,820

[22] Filed: Mar. 23, 1992

[30] Foreign Application Priority Data

Mar. 28, 1991 [IT] Italy ..... MI91A000841

[51] Int. Cl.[5] ..... A47D 7/00

[52] U.S. Cl. ..... 5/99.1; 5/98.1

[58] Field of Search ..... 5/93.1, 98.1, 99.1, 5/176.1

[56] References Cited

U.S. PATENT DOCUMENTS 2,486,054 10/1949 Morse ..... 5/98.1
2,574,079 11/1951 White ..... 5/99.1
3,605,139 9/1971 Lorentz, Jr. ..... 5/99.1
4,008,499 2/1977 Wren, Jr. et al. ..... 5/99.1
4,688,280 8/1987 Kohus et al. ..... 5/99.1
4,811,437 3/1989 Dillner et al. ..... 5/99.1

*Primary Examiner*—Michael F. Trettel
*Attorney, Agent, or Firm*—Guido Modiano; Albert Josif

[57] ABSTRACT

The framework, particularly for folding cots, includes an upper frame having a pair of longitudinal members and a pair of cross-members which are pivoted to corner joints and which can be folded in a median portion. Corner legs are associated with the corner joints, and the cover legs are articulated to a lower frame which is substantially H-shaped and which include rods which are articulated proximate to the lower end of the legs at one of their ends and which are connected in pairs to the ends of the central portion of the H-shaped frame at their other end. The central portion has a first lower connecting joint and a second lower connecting joint, each of which is articulated to the end of connecting rods which are articulated to a central plate at their other end.

6 Claims, 3 Drawing Sheets

FRAMEWORK, PARTICULARLY FOR FOLDING COTS

BACKGROUND OF THE INVENTION

The present invention relates to a framework, particularly for folding cots.

As is known, folding cots, generally for children, are already commercially available which are constituted by an upper rectangular frame defined by a pair of long sides and a pair of short sides which are articulated to corner joints and can be folded in a median portion. Corner legs are connected to the corner joints, and are articulated, proximate to their lower end, with struts which are articulated, at their other end, to a single central joint to which intermediate supporting feet or legs are also articulated.

In order to close the framework, the long sides and the short sides are folded so as to lower the median region of mutual articulation. The and the single central joint correspondingly rises so that in closed position the framework substantially has its four corner legs arranged mutually side by side, in practice defining a parallelepiped.

These known cots have the disadvantage of being unstable when the framework is in an open position, since the articulation of all the lower struts by a single central joint unavoidably creates instability factors, are provided for locking the struts with respect to the joint, retaining them in the open framework position. Accordingly, fi the child moves, stresses may occur which make the entire framework unstable. Another disadvantage is constituted by the fact that they are structurally very complicated and not always practical in use.

SUMMARY OF THE INVENTION

The aim of the invention is indeed to eliminate the disadvantages described above by providing a framework, particularly for folding cots, which allows to assume, in open position, a considerably stable configuration by virtue of the use of a particular lower frame which joins the corner legs and includes central supporting elements.

Within the scope of the above aim, a particular object of the invention is to provide a framework which has means capable of locking the arrangement of the framework in an open position, i.e. whereby to stabilize at the lower frame which joins the corner legs, naturally with the possibility of unlocking the framework by exerting a force from the outside in order to close the framework.

Another object of the present invention is to provide a framework which is capable of giving the greatest assurances of reliability and safety in use.

A further object of the present invention is to provide a framework, particularly for folding cots which can be easily obtained with commonly commercially available means and is furthermore advantageous from a merely economical point of view.

This aim, these objects and others which will become apparent hereinafter are achieved by a framework, particularly for folding cots, which comprises an upper frame constituted by a pair of members and by a pair of cross-members which are pivoted to corner joints and can be folded in a median portion, corner legs being associated with said corner joints. The framework further comprises a lower substantially H-shaped frame constituted by rods which are articulated proximate to the lower end of said legs at one end and are connected in pairs to the ends of the central portion of said H-shaped frame at their other end. The central portion has a first lower connecting joint and a second lower connecting joint, each of said lower connecting joints being articulated to the end of connecting rods, which have another end articulated to a central plate.

BRIEF DESCRIPTION OF THE DRAWINGS

Further characteristics and advantages will become apparent from the description of a preferred but not exclusive embodiment of a framework structure, particularly for folding cots, illustrated only by way of non-limitative example in the accompanying drawings, wherein.

DESCRIPTION OF THE PREFERRED EMBODIMENTS

Figure 1:
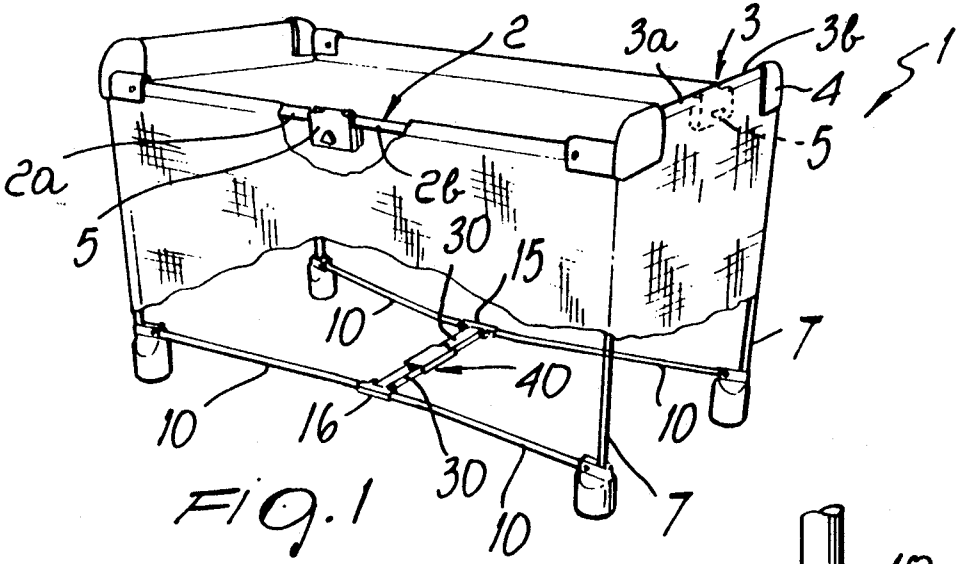
FIG. 1 is a schematic view of the framework in an open position, in which the covering fabric of the cot is only partially indicated.
Figure 4:
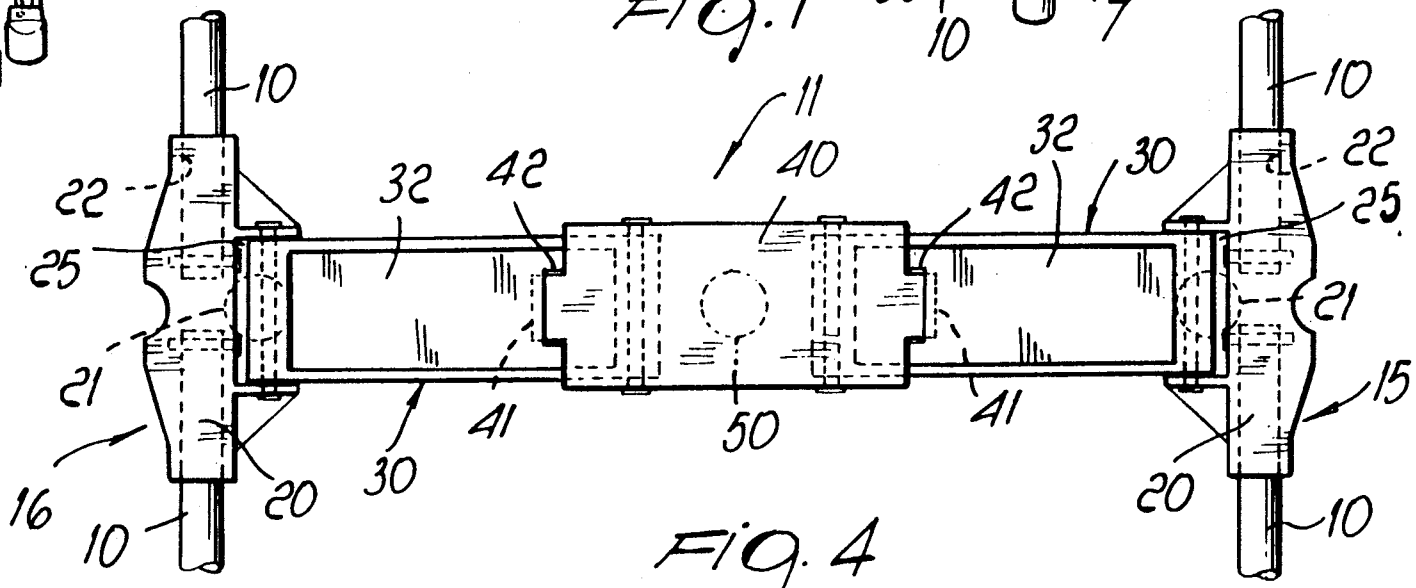
FIG. 4 is a top-plan view of the central portion of the H-shaped frame.

With reference to the above figures, the framework, particularly for folding cots, according to the invention, which is generally indicated by the reference numeral 1, comprises an upper frame having a pair of longitudinal members 2 and a pair of cross-members 3 which are pivoted to corner joints 4, with the possibility of articulation about an axis which is perpendicular to their arrangement.

Figure 7:
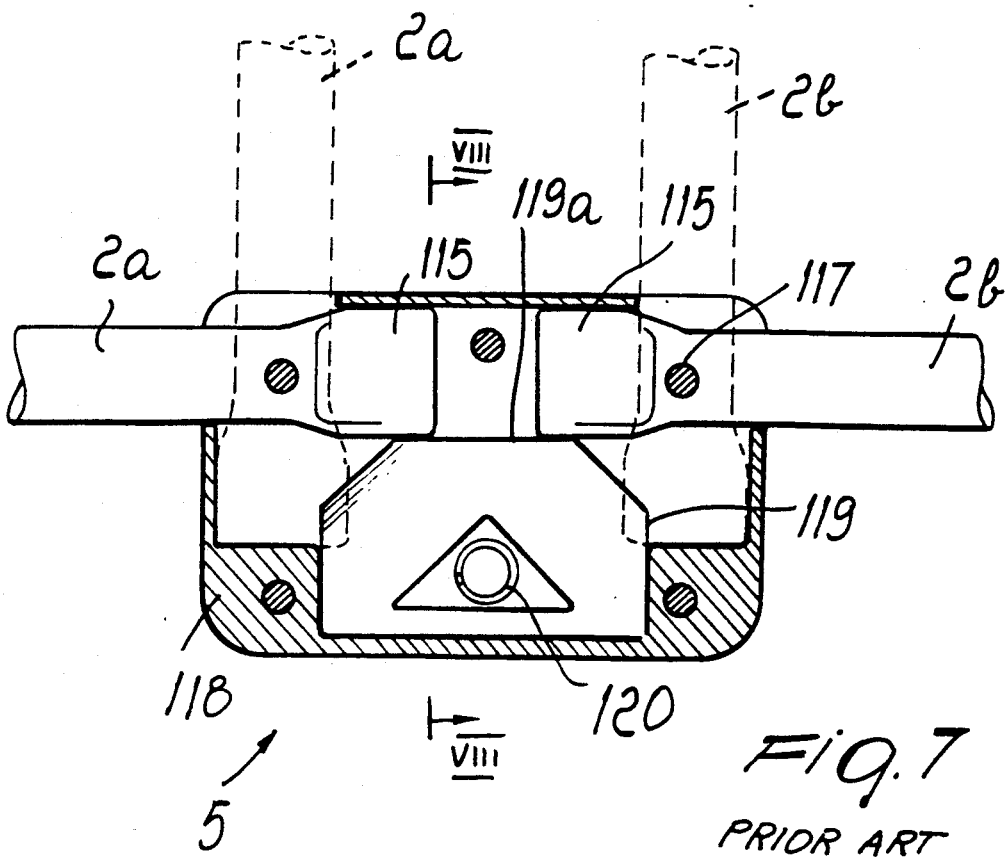
Fig. 7 PRIOR ART
FIG. 7 is a partly sectional view of a releasable locking joint of the framework of FIG. 1.
Figure 8:
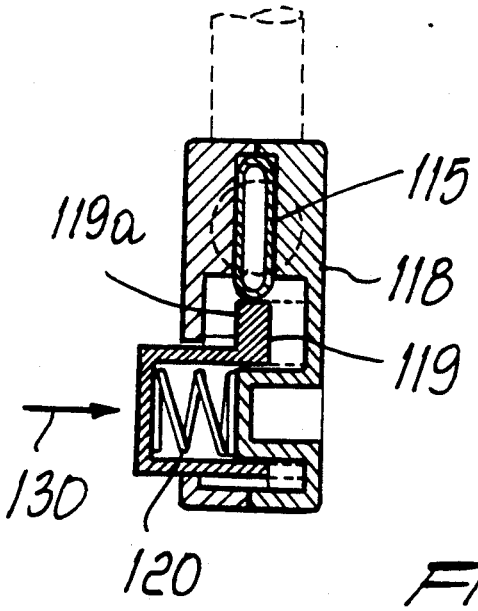
Fig. 8 PRIOR ART
FIG. 8 is a cross-sectional view of the releasable locking joint taken on the section line VIII—VIII of FIG. 7.

The longitudinal members 2 and the cross-members 3 are respectively constituted by portions 2*a* and 2*b* and by portions 3*a* and 3*b* which can be folded in a median region. The portions 2*a*, 2*b*, 3*a*, 3*b* are mutually pivoted with the interposition of a removable locking joint 5 which can be for example of the type illustrated in FIGS. 7 and 8. The locking joint 5 is of a known type which comprises a central block 118 having slideably connected thereto a cam 119 defining an alignment surface 119*a*. In the illustrated example, the ends 115 of the portions 2*a*, 2*b* are rotatably connected to the block 118 at pivot points 117 and a spring 20 biases the cam 119 to a position whereat the alignment surface 119*a* abuts the ends 115 of the portions 2*a*, 2*b*, whereby to horizontally align the portions 2*a*, 2*b* of the longitudinal member 2 in an open position of the framework 1. In order to fold the portions 2*a*, 2*b* of the opened longitudinal member 2, one simply pushes the cam 119 against the biasing action of the spring 120 in the direction of the arrow 130 in FIG. 8, i.e., towards the block 118, thereby disengaging the alignment surface 119*a* from the ends 115 of the portions 2*a*, 2*b*. Once the alignment surface 119*a* has been disengaged from the ends 115 of the portions 2*a*, 2*b*, the longitudinal member 2 can be folded by rotating the portions 2*a*, 2*b* about the pivots 117. The portions 3*a*, 3*b* of the cross-members 3 are interconnected by a locking joint 5 in an identical manner to that described heretofore with respect to the longitudinal member 2.

Corner legs 7 extend from the corner joints 4 and are rigidly associated with said corner joints 4. The legs 7 extend perpendicular to the articulation axes of the members 2 and of the cross-members 3.

In its lower part, the framework has a substantially H-shaped lower frame, generally indicated by the reference numeral 8, which is constituted by rods 10 which are articulated to the legs 7 and which can rotate about an axis which is substantially perpendicular to the longitudinal extension of said rods.

At their other end, the rods 10 are articulated in pairs to the ends of the central portion 11 of the H-shaped frame 8.

The central portion 11 is constituted by a first lower connecting joint 15 and by a second lower connecting joint 16.

More in detail, the rods connected to adjacent legs are articulated to each of the points 15 and 16, and preferably the rods which are connected to a side which corresponds to the members are articulated to each lower connecting joint.

The joints 15 and 16, which have a mutually symmetrical configuration, comprise a central body 20; a supporting foot 21, defined monolithically with said joint, extends from a lower face of said central body.

Each joint furthermore defines insertion coupling channels 22 which are arranged mutually opposite and aligned; said channels 22 are open toward the lower face and allow the articulation of the ends of the rods 10.

On the upper side, each joint defines a bracket-shaped portion 25 above which the end of a connecting rod indicated by 30 is articulated; at its other end, said connecting rod is articulated to the lower face of a central plate 40 which in practice constitutes the connecting element of the central portion 8.

The connecting rods 30 have an elongated configuration which is in any case shorter than half the length of the short side of the framework.

Means for releasably locking the framework in an open position act between the central plate 40 and the connecting rods 30 and are constituted by an elastically yielding tooth 41 which extends downward from opposite ends of the central plate 40 and inserts in a snap-together manner in a slot 42 which is correspondingly provided on the end of the connecting rods 30. The slots 42 advantageously are provided with an inclined portion 42*a* which facilitates the disengagement of the resilient tooth 41 therefrom.

The connecting rods 30 are preferably provided with elongated side wall 31, which are joined by a planar central portion 32 within which the slot 42 is defined.

The connecting rods are articulated to the central plate 40 and to the joints 15 and 16 about axes which are substantially mutually parallel and substantially perpendicular to the articulation axis between the joints 15 and 16 and the rods 10.

A central supporting foot 50 extends from the lower face of the plate 40 and thus allows to provide a wide supporting region in the central portion of the framework, since three feet are available, i.e. the two feet 21 and the central foot 50, which in practice are directly included in the joint which defines the central portion of the framework.

In practical use, when the framework is in open position, the locking joints provided on the longitudinal members and on the cross-members are locked so as to keep the portions 2*a* and 2*b* and the portions 3*a* and 3*b* mutually aligned. In order to lock the lower part of the framework in an open position, the connecting rods 30 each have one end portion which abuts against the lower face of the central plate 40, and an opposite end portion which abuts against the upper face of the bracket-shaped portion 25, thus providing an abutment element which prevents the free rotation of the connecting rod.

In this position, the elastically yielding teeth 41 furthermore couple to the connecting rods 30, thus considerably increasing the locking.

In order to close the framework it is necessary to release the locking joints of the longitudinal members and cross-members, allowing the downward folding of their median portion, and it is furthermore sufficient to exert an upward thrust action on the lower face of the plate 40, thus overcoming the elastic biasing action exerted by the teeth 41 in the slots 42.

Figure 6:
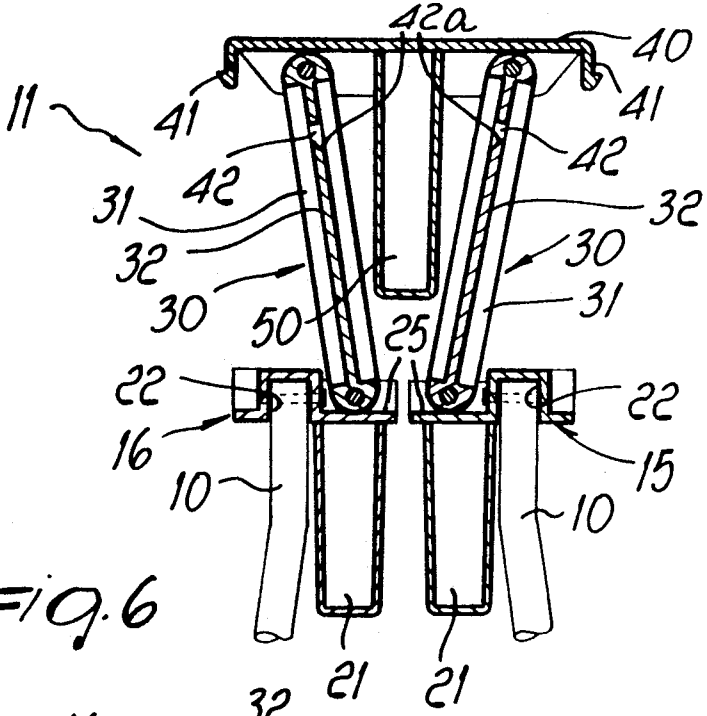
FIG. 6 is a view of the central portion when the framework is closed.
Figure 5:
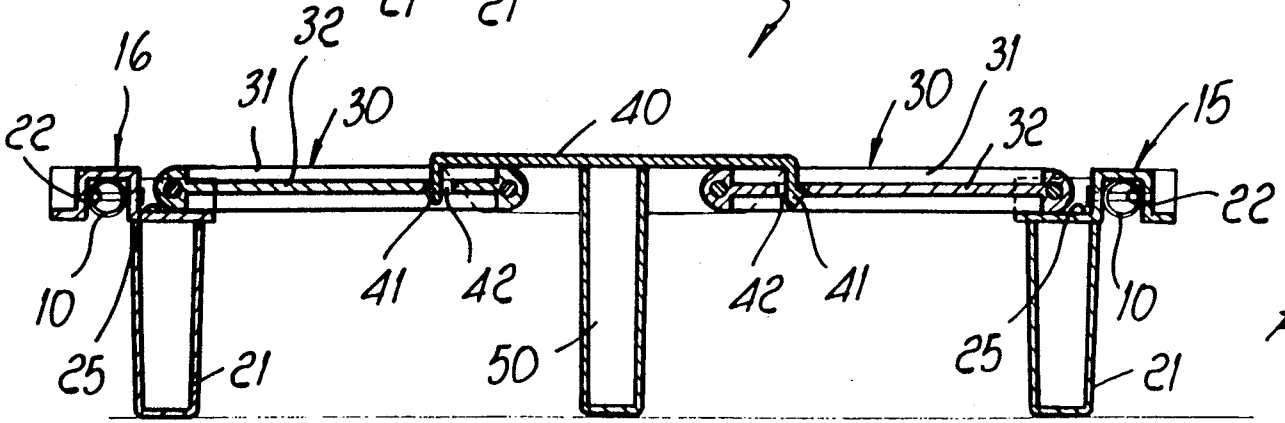
FIG. 5 is an elevation view of the central portion in an open position.

In these conditions it is possible to compact the framework until the four legs are moved practically side by side toward the center, with the rods pushing the central plate upward, as shown in FIG. 6.

It should also be noted that when the framework is in the open position, the rods 10 are not arranged exactly below the longitudinal members but are arranged slightly inward so as not to create mutual interference during the closing of the framework.

To the above it should be furthermore added that the use of two lower connecting joints, which are considerably spaced from one another and are linked by connecting rods, allows to have mutually spaced supporting feet which are directly included in said joints.

From the above it can thus be seen that the framework according to the invention achieves the intended aim and objects, and in particular the fact is stressed that a framework for folding cots is provided which, when the cot is in open position, gives considerable stability, also taking into account the fact that any effort which acts from above tends to further stabilize, the locking, consequently eliminating instability of the framework.

Figure 2:
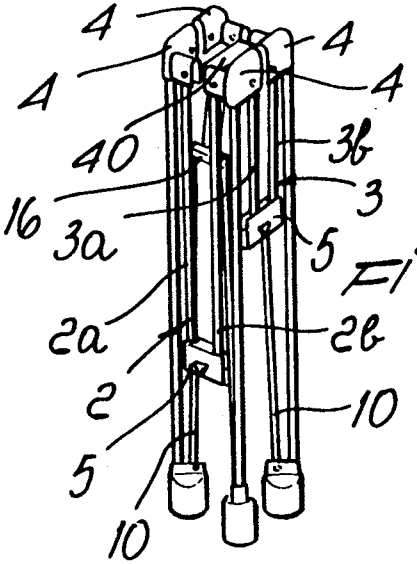
FIG. 2 is a schematic perspective view of the framework in a closed position.
Figure 3:
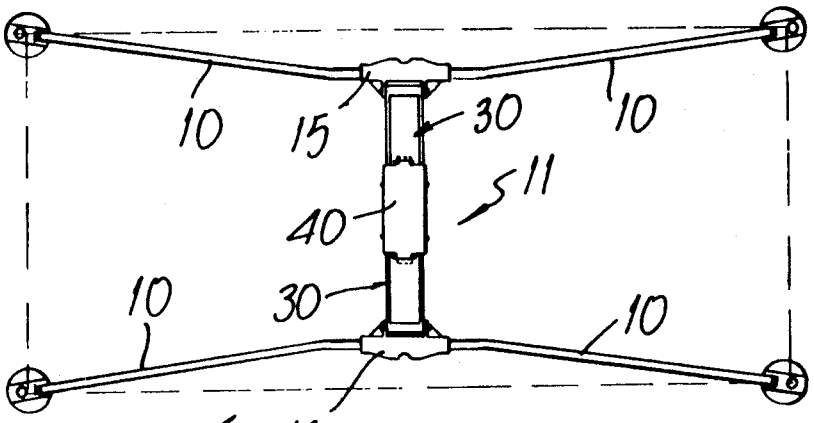
FIG. 3 is a schematic top plan view of the framework.

Furthermore, the lower H-shaped frame imparts stability to the entire framework. Also, by employing a central portion with foldable couplings at the joints, the connecting rods and the central plate, in the manner described heretofore, the folded framework is very compact, as can be seen in FIG 2.

Furthermore, the lower H-shaped frame imparts stability to the entire framework. Also, by employing a central portion with foldable couplings at the joints, the connecting rods and the central plate, in the manner described heretofore, the folded framework is very compact, as can be seen in FIG. 2.

The invention thus conceived is susceptible to numerous modifications and variations, all of which are within the scope of the inventive concept.

All the details may furthermore be replaced with other technically equivalent elements.

In practice, the materials employed, as well as the contingent shapes and dimensions, may be any according to the requirements.

We claim:

1. Framework, particularly for folding cots, which comprises an upper frame comprising a pair of longitudinal members and a pair of cross-members which are pivoted to corner joints, said pair of cross members and said pair of longitudinal members each being foldable at a median portion thereof, corner legs being associated with said corner joints, further comprising a lower frame which is substantially H-shaped and which comprises rods, said rods each having an end articulated proximate to the lower end of said legs, said rods having other ends connected in paris to the ends of a central portion of said H-shaped frame, said central portion having a first lower connecting joint and a second lower connecting joint, each of said lower connecting joints being articulated to the end of connecting rods which are articulated to a central plate at their other end.

2. Framework according to claim 1, wherein said first lower connecting joint and said second lower connecting joint are mutually symmetrical and each comprise a central body, and wherein said central body has a lower face, said framework further comprising a supporting foot extending from the lower face of said central body, insertion coupling channels being defined on said lower face, said channels being open toward the lower face and being mutually opposite and aligned, the ends of said rods being articulated in said channels.

3. Framework according to claim 2, wherein said central body defines has an upper face, and wherein said central body defines on said upper face, a bracket-shaped portion above which an end of said connecting rods is articulated, said connecting rods being articulated, at their other end, to the lower face of said central plate.

4. Framework according to claim 3, comprising removable locking means which interact between said central plate and said connecting rods.

5. Framework according to claim 4, wherein said connecting rods each have a central part, and, wherein said removable locking means comprise elastically yielding teeth which extend from opposite ends of said central plate and can be elastically inserted in slots defined in the central part of said connecting rods extent.

6. Framework according to claim 3, wherein when said framework is in an open position said connecting rods abut against the lower face of said central plate at one end for a certain extent and abut against the upper face of said bracket-shaped portion at the other end for a certain extent.

* * * * *